United States Patent [19]

Nakamura et al.

[11] Patent Number: 4,595,652

[45] Date of Patent: Jun. 17, 1986

[54] HEAT-DEVELOPABLE LIGHT-SENSITIVE MATERIAL WITH POLYMERIC BASE PRECURSOR

[75] Inventors: Taku Nakamura; Akira Hibino; Hiroyuki Hirai, all of Kanagawa, Japan

[73] Assignee: Fuji Photo Film Co., Ltd., Kanagawa, Japan

[21] Appl. No.: 760,435

[22] Filed: Jul. 30, 1985

[30] Foreign Application Priority Data

Jul. 30, 1984 [JP] Japan ..... 59-159947

[51] Int. Cl.[4] ..... G03C 1/40; G03C 1/06

[52] U.S. Cl. ..... 430/559; 430/203; 430/495; 430/617; 430/619; 430/955

[58] Field of Search ..... 430/617, 619, 955, 353, 430/203, 559, 495

[56] References Cited

U.S. PATENT DOCUMENTS

| | | | |
|---|---|---|---|
| 4,060,420 | 11/1977 | Merkel et al. | 430/955 |
| 4,088,496 | 5/1978 | Merkel | 430/619 |
| 4,473,631 | 9/1984 | Hirai et al. | 430/619 |

OTHER PUBLICATIONS

Arcesi et al., "Aminimides . . . Elements", *Research Disclosure* No. 15733, 5/1977 pp. 60,61.

DeSelms et al., "Base Generating Aminimides . . . ", *Research Disclosure* No. 15776, 5/1977, pp. 67+68.

Wilson, "Polymeric Aminimides . . . ", *Research Disclosure* No. 15732, 5/1977, p. 43.

Carpenter et al., "Photothermographic Silver Halide Systems", *Research Disclosure* No. 17029, pp. 9-15, 6/1978.

*Primary Examiner*—Richard L. Schilling

*Attorney, Agent, or Firm*—Sughrue, Mion, Zinn, Macpeak & Seas

[57] ABSTRACT

A heat-developable light-sensitive material is described, characterized by containing a polymer having a functional group releasing a basic component upon thermal decomposition in the side chain thereof. This polymer is a new base precursor which when added to heat-developable light-sensitive materials increases their storage stability and permits them to form an image of high density and decreased in fog even after storage. Preferred examples of such polymers are polymers having a repeating unit represented by the general formula (I):

(I)

wherein $R_1$, $R_2$ and $R_3$ are each a univalent group, L is a divalent connecting group having from 1 to 20 carbon atoms, M is a cation and x is a number equivalent with the valence of M.

16 Claims, No Drawings

HEAT-DEVELOPABLE LIGHT-SENSITIVE MATERIAL WITH POLYMERIC BASE PRECURSOR

FIELD OF THE INVENTION

The present invention relates to a heat-developable light-sensitive material containing a base precursor.

The term "base precursor" is used herein to mean a compound releasing a basic component by thermal decomposition.

BACKGROUND OF THE INVENTION

A heat-developable light-sensitive material usually contains either a base or a base precursor for the purpose of accelerating development due to heating. From the viewpoint of the storage stability of the light-sensitive material, it is preferred to use the base precursor releasing a basic substance on thermal decomposition.

Typical examples of such base precursors are described in British Pat. No. 998,949. Preferred base precursors are the salts of carboxylic acids and organic bases; useful carboxylic acids include trichloroacetic acid and trifluoroacetic acid, and useful bases include guanidine, piperidine, morpholine, p-toluidine, and 2-picoline. Particularly useful is guanidine trichloroacetate described in U.S. Pat. No. 3,220,846. In addition, aldoneamides described in Japanese Patent Application (OPI) No. 22625/75 (the term "OPI" as used herein refers to a "published unexamined Japanese patent application") are preferably used since they produce bases upon decomposition at elevated temperatures.

Many of these base precursors, however, need relatively long periods of time for the formation of images and are likely to cause fogging. In addition, they have disadvantages in that they are readily influenced by air or moisture and thus are likely to undergo decomposition under the influence of air or moisture, thereby causing variations in the photographic properties of the light-sensitive material and deteriorating the storage stability of the light-sensitive material.

SUMMARY OF THE INVENTION

The present invention is intended to overcome the above disadvantages.

An object of the present invention is to provide a heat-developable light-sensitive material which permits the formation of an image of high density in a short period of time.

Another object of the present invention is to provide a heat-developable light-sensitive material containing a new base precursor which enables formation of an image of high density and low fog.

Still another object of the present invention is to provide a heat-developable light-sensitive material having excellent storage stability.

The term "storage stability" is used herein to mean the stability of photographic properties such as maximum density, minimum density, and sensitivity during the storage of the heat-developable light-sensitive material prior to heat development.

It has been found that the above objects can be attained by using as base precursors polymers having a functional group releasing a basic component of thermal decomposition in the side chain.

Accordingly, the present invention relates to a heat-developable light-sensitive material characterized by containing as a base precursor a polymer having a functional group releasing a basic component upon thermal decomposition in the side chain.

DETAILED DESCRIPTION OF THE INVENTION

Preferred examples of the polymeric base precursor of the present invention are the salts of polymer carboxylic acids, causing decarboxylation at 80° to 250° C., preferably 100° to 200° C.

Preferred examples of such polymer carboxylic acid salts causing decarboxylation in the above temperature range are compounds having a repeating unit represented by the following general formula (I):

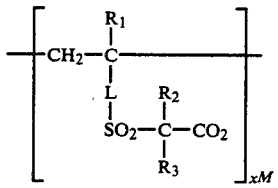

(I)

wherein $R_1$, $R_2$ and $R_3$ are each a univalent group, L is a divalent connecting group having from 1 to 20 carbon atoms, M is a cation, and x is a number equivalent with the valence of M.

The symbols of the general formula (I) will hereinafter be explained in greater detail.

$R_1$, $R_2$ and $R_3$ are each a univalent group, such as a hydrogen atom, a lower alkyl group having from 1 to 6 carbon atoms (e.g., a methyl group, an ethyl group, a hydroxyethyl group, an n-propyl group, an n-butyl group, an n-amyl group, an n-hexyl group, a carboxymethyl group, a cyanomethyl group, a methoxycarbonylmethyl group, and a cyanoethyl group), a carboxyl group, a cyano group, a nitro group, an alkoxycarbonyl group (e.g., a methoxycarbonyl group and an ethoxycarbonyl group), an aryl group (e.g., a phenyl group, a tolyl group, a p-chlorophenyl group, and a naphthyl group), and an aralkyl group (e.g., a benzyl group and a phenethyl group). Particularly preferred are a hydrogen atom, a methyl group, an ethyl group, a cyano group, a methoxycarbonyl group, a phenyl group, and a benzyl group.

L is a divalent connecting group having from 1 to 20 carbon atoms, such as an alkylene group (e.g., a methylene group, an ethylene group, a trimethylene group, and a hexamethylene group), a phenylene group (e.g., an o-phenylene group, a p-phenylene group, and an m-phenylene group), an arylenealkylene group (e.g.,

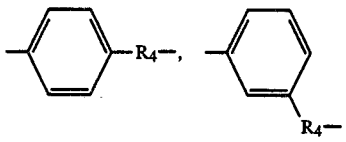

(wherein $R_4$ is an alkylene group having from 1 to 12 carbon atoms)), $—CO_2—$, $—CO_2—R_5—$ (wherein $R_5$ is a divalent group, such as an alkylene group, a phenylene group, an arylenealkylene group, a group containing an amido bond, and a group containing an ester bond), $—CONH—R_5—$ (wherein $R_5$ is the same as defined above), and

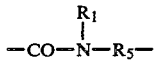

(wherein $R_1$ and $R_5$ are the same as defined above). The following are particularly preferred.

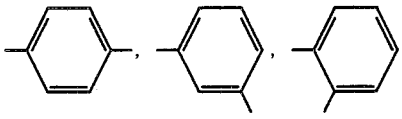

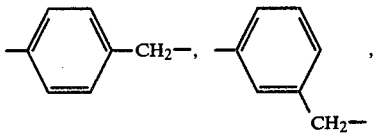

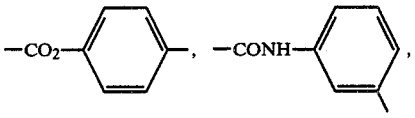

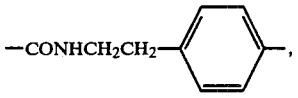

$-CONHCH_2CH=CHCH_2-$, $-CONHCH_2-$, $-CONHCH_2NHCOCH_2-$, $-CONHCH_2NHCOCH_2CH_2-$.

M is an alkali metal ion (e.g., a sodium ion, a potassium ion, and a cesium ion), an alkaline earth metal ion (e.g., a calcium ion and a barium ion), a quaternary ammonium ion (e.g., a tetramethylammonium ion, a tetrabutylammonium ion, a trimethylbenzylammonium ion, and a cetyltrimethylammonium ion), and a protonated base (e.g., triethylamine, diethylamine, dimethylbenzylamine, diazabicycloundecene, diazabicyclooctane, guanidine, ethylenebisguanidine, and methylguanidine, all being protonated). Particularly preferred are a sodium ion, a potassium ion, a cesium ion, a protonated guanidine, and a protonated methylguanidine.

Preferred examples of the repeating unit or monomer unit represented by the general formula (I) are shown below.

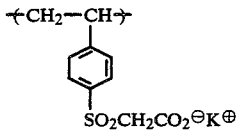

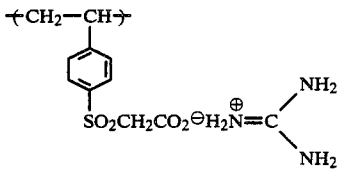

-continued

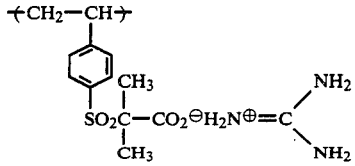

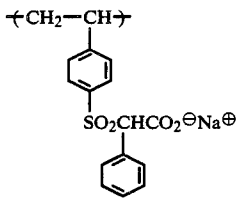

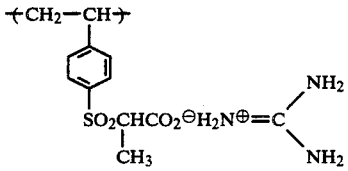

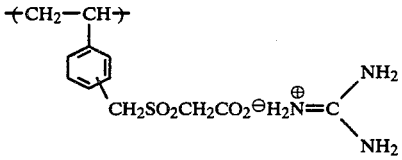

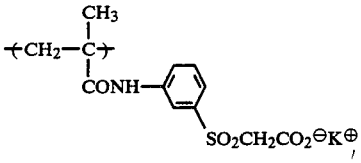

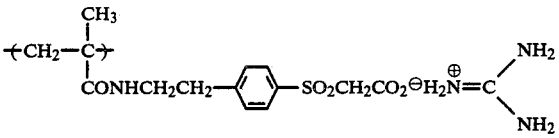

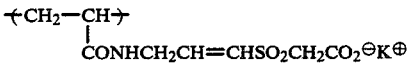

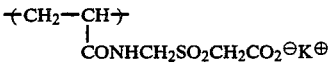

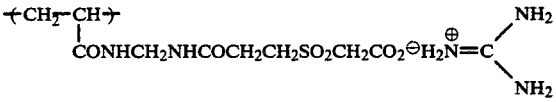

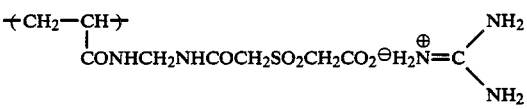

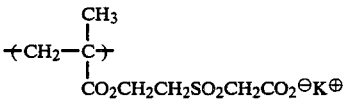

-continued

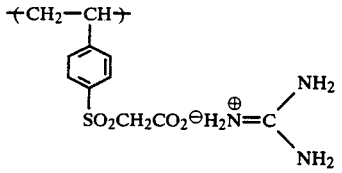

Polymeric base precursors which are preferably used in the present invention may contain, as well as the repeating unit represented by the general formula (I), other repeating units for the purpose of controlling solubility and/or or a glass transition point.

A preferred example of the other repeating unit is a monomer unit resulting from copolymerization of a vinyl monomer. Preferred examples of such vinyl monomers are ethylene, propylene, butene-1, isobutene, styrene, α-methylstyrene, vinyltoluene, monoethylenically unsaturated esters of aliphatic acids (e.g., vinyl acetate and allyl acetate), monoethylenically unsaturated amides of aliphatic acids (e.g., N-vinylpyrrolidone and N-vinyl acetamide), esters of ethylenically unsaturated mono- or dicarboxylic acids (e.g., methyl methacrylate, ethyl acrylate, n-butyl acrylate, n-butyl methacrylate, benzyl acrylate, diethyl maleate, and diethyl itaconate), ethylenically unsaturated monocarboxylic acid amides (e.g., acrylamide, dimethylacrylamide, methacrylamide, diacetoneacrylamide, acryloylmorpholine and sodium 2-methyl-2-acrylamidopropanesulfonate), monoethylenically unsaturated compounds (e.g., acrylonitrile), and dienes (e.g., butadiene and isoprene). Of these compounds, styrene, esters of ethylenically unsaturated carboxylic acids, and ethylenically unsaturated carboxylic acid amides are particularly preferred.

In transforming the polymeric base precursors preferably used in the present invention into the corresponding cross-linked latexes, vinyl monomers containing two or more copolymerizable unsaturated bonds in the molecule can be used. Preferred examples of such vinyl monomer units are divinylbenzene, ethylene glycol dimethacrylate, propylene glycol dimethacrylate, methylenebisacrylamide, and ethylene glycol diacrylate. Of these compounds, divinylbenzene, ethylene glycol dimethacrylate and ethylene glycol diacrylate are particularly preferred.

The proportion of the repeating unit represented by the general formula (I) in the polymeric base precursors preferably used in the present invention is from 10 to 100 mol% and preferably from 50 to 100 mol%.

It is preferred that the molecular weight of the polymeric base precursors preferably used in the present invention be at least 10,000 from the viewpoints of photographic characteristics, coating suitability, and so forth. When the polymeric base precursor is used in solution form, its molecular weight is less than 1,000,000 and preferably less than 300,000 from the viewpoint of coating properties. When a vinyl monomer unit containing two or more copolymerizable unsaturated bonds in the molecule is used as a vinyl monomer unit, the molecular weight of the polymeric base precursor is infinite, and thus it is used as a dispersion with respect to coating properties.

Examples of the polymeric base precursors preferably used in the present invention are shown below.

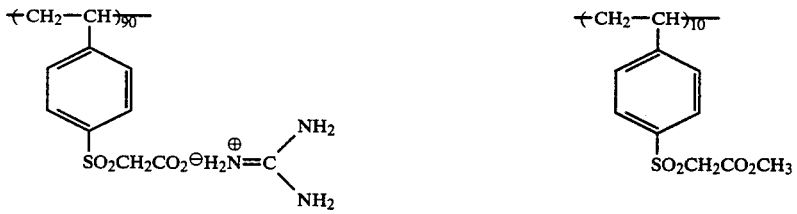

P-1

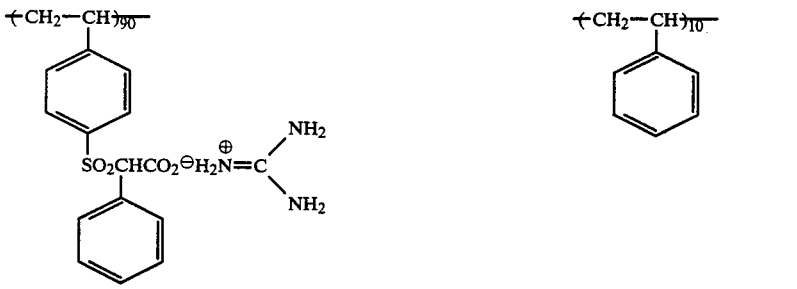

P-2

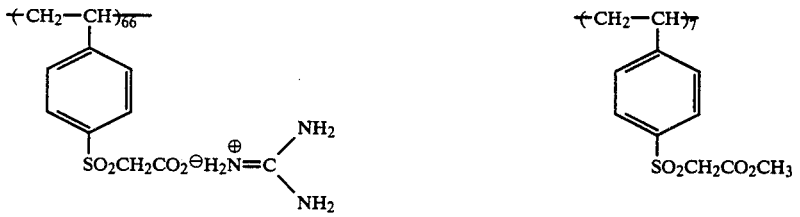

P-3

-continued

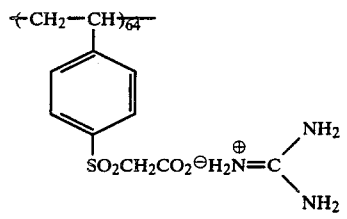

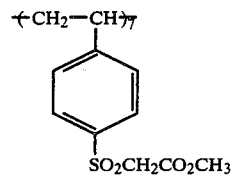

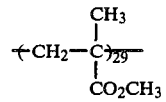

P-4

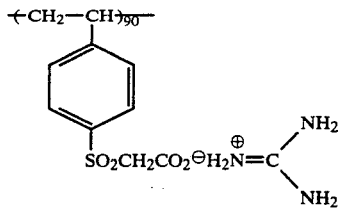

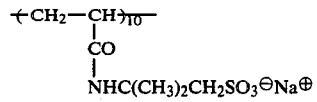

P-5

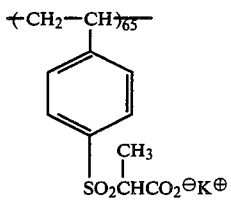

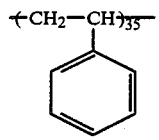

P-6

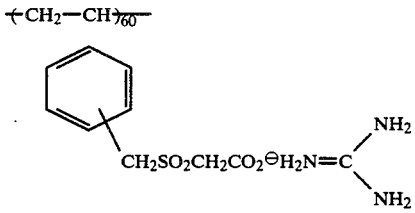

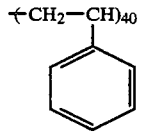

P-7

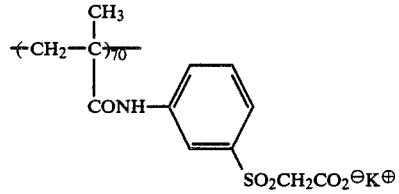

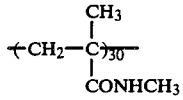

P-8

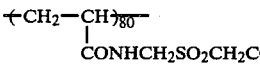

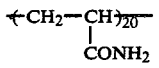

P-9

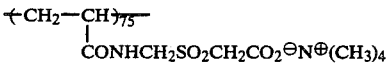

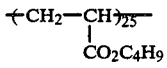

P-10

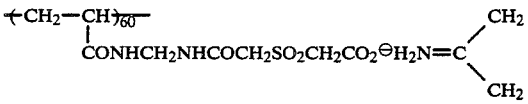

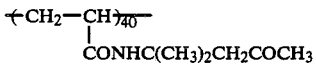

P-11

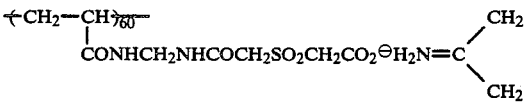

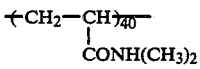

P-12

The polymeric base precursors preferably used in the present invention can be prepared by known methods. One of the methods is to homopolymerize a vinyl monomer having a functional group releasing a basic component upon heating, or to copolymerize such a vinyl monomer with another vinyl monomer. Another method is to react a polymer carboxylic acid causing decarboxylation on heating or its ester with a corresponding base.

Polymer carboxylic acids causing decarboxylation on heating can be prepared by known methods such as a method in which thioglycolic acid derivatives are oxidized, and a method in which sulfinic acid and chloroacetic acid derivatives are reacted.

Examples of the method for preparation of the polymeric base precursors preferably used in the present invention are shown below.

PREPARATION EXAMPLE 1

Preparation of Methyl p-Vinylbenzenesulfonylacetate/Guanidine p-Vinylbenzenesulfonyl Acetate Copolymer (P-1)

To 188 ml of dimethyl sulfoxide was added 54.2 g of potassium p-vinylbenzenesulfinate, and the resulting mixture was stirred while heating at 50° C. Then, 23.0 ml of methyl chloroacetate was added dropwise to the mixture over 1 hour while maintaining it at 50° C., and the resulting mixture was stirred for 1 hour while maintaining at 50° C. The reaction mixture was cooled to room temperature and extracted with ethyl acetate, and the ethyl acetate was distilled away at an outer temperature of not more than 40° C. to yield 60.1 g of oily methyl p-vinylbenzenesulfonylacetate.

To 60.0 g of methyl p-vinylbenzenesulfonylacetate was added 90.0 g of acetonitrile. After thorough replacement with nitrogen gas, the mixture was heated to 75° C. When the temperature became constant, 0.31 g of 2,2'-azobis(2,4-dimethylvaleronitrile) was added. After heating for 2 hours, 0.31 g of 2,2'-azobis(2,4-dimethylvaleronitrile) was again added, and the resulting mixture was heated for 3 hours. The reaction mixture was cooled to room temperature, and then 900 ml of methyl alcohol was poured into the reaction mixture to yield 57.0 g of polymethyl p-vinylphenylsulfonylacetate.

To 50.0 g of the above prepared polymer was added 175 ml of acetonitrile, and the resulting mixture was heated to 50° C. Then, 100 ml of aqueous solution containing 16.9 g of guanidine carbonate was added dropwise to the mixture over 15 minutes. The mixture was heated for 1 hour and then cooled to room temperature, and 1.25 ml of ethyl alcohol was added to the mixture to yield 50.3 g of the desired polymer (P-1).

PREPARATION EXAMPLE 2

Preparation of Butyl Methacrylate/Methyl p-Vinylbenzenesulfonylacetate/Guanidine p-Vinylbenzenesulfonylacetate Copolymer (P-3)

To a mixture of 11.4 g of butyl methacrylate and 38.6 g of methyl p-vinylbenzylsulfonylacetate was added 75.0 g of acetonitrile. After thorough replacement with nitrogen gas, the mixture was heated to 70° C., and when the temperature of the mixture became constant, 0.30 g of 2,2'-azobis(2,4-dimethylvaleronitrile) was added. After the mixture was heated for 2 hours, 0.30 g of 2,2'-azobis(2,4-dimethylvaleronitrile) was again added, and the resulting mixture was heated for 3 hours. The reaction mixture was cooled to room temperature and then 1 l of methyl alcohol was added to yield 40.6 g of a butyl methacrylate/methyl p-vinylbenzenesulfonylacetate copolymer.

To 20.0 g of the above prepared copolymer was added 70 ml of acetonitrile, and the resulting mixture was heated to 50° C. Then, 40 ml of an aqueous solution containing 5.2 g of guanidine carbonate was added dropwise over 15 minutes. The resulting mixture was heated for 1 hour and then cooled to room temperature, and 1 l of ethanol was added to yield 20.3 g of the desired polymer (P-3).

Polymers (P-4), (P-5), (P-8) and (P-10) were prepared in the same manner as above.

The amount of the polymeric base precursor used can be varied over a wide range; when calculated as the weight of the base precursor unit per the coating film, it is appropriately 50 wt% or less and preferably from 0.01 to 40 wt%.

The polymeric base precursors of the present invention can be used singly or as a mixture comprising two or more thereof. They may be used in combination with dye releasing aids as described hereinafter.

The polymeric base precursor may be incorporated in any position of the heat-developable light-sensitive material (e.g., an intermediate layer, a protective layer and an emulsion layer) as long as it can have a chemical interaction with silver halide when heating and accelerate development. Preferably it is added to a silver halide emulsion layer or its adjacent layer.

The present invention can be applied to any heat-developable light-sensitive materials known in the art.

In the present invention silver can be used as an image forming substance or various image forming substances can be used by various procedures.

Such image forming substances include couplers forming a color image on coupling with the oxidized products of developers widely used in liquid development, such as magenta couplers, yellow couplers and cyan couplers. Examples of the magenta couplers are a 5-pyrazolone coupler, a pyrazolobenzimidazole coupler, a cyanoacetylcumarone coupler and an open chain acylacetonitrile coupler. An example of the yellow couplers is an acylacetamide coupler (e.g., benzoylacetanilides and pivaloylacetanilides). Examples of the cyan coupler are a naphthol coupler and a phenol coupler. It is desirable for these couplers to be nondiffusing by containing a hydrophobic group called a ballast group in the molecule, or to be polymerized. The couplers may be 4-equivalent or 2-equivalent relative to the silver ion. In addition, colored couplers having the effect of color correction, or couplers releasing a development inhibitor with the progress of development (so-called DIR couplers) can be used.

Dyes forming a positive color image by the light-sensitive silver dye bleaching method, such as dyes described in *Research Disclosure,* April 1976, pp. 30–32 (RD-14433), ibid., Dec. 1976, pp. 14–15 (RD-15227), and U.S. Pat. No. 4,235,957, and dyes described in U.S. Pat. Nos. 3,985,565 and 4,022,617 can also be used.

In addition, dyes with a nitrogen-containing heterocyclic group introduced therein as described in *Research Disclosure,* May 1978, pp. 54–58 (RD-16966) can be used.

In addition, dye providing substances releasing a mobile dye by utilizing a coupling reaction with a reducing agent oxidized with an oxidation-reduction reaction with silver halide or an organosilver salt at elevated temperatures as described in European Pat. Nos. 79,056, 67,455 and West German Pat. No. 3,217,853, and dye providing substances releasing a mobile dye as a result of an oxidation-reduction reaction with silver halide or an organosilver salt at elevated temperatures as described in European Pat. Nos. 76,492, 66,282, West German Pat. No. 3,215,485, Japanese Patent Application No. 28928/83 (corresponding to U.S. patent application Ser. No. 582,655, filed on Feb. 23, 1984) and U.S. Pat. No. 4,503,137 can be used.

Dye providing substances preferably used in the present invention are represented by the following general formula (CI):

$$(\text{Dye}-X)_q-Y$$

In the above general formula (CI), Dye represents a dye which becomes mobile when released from the molecule and which preferably has a hydrophilic group. Dyes which can be used include azo dyes, azomethine dyes, anthraquinone dyes, naphthoquinone dyes, styryl dyes, nitro dyes, quinoline dyes, carbonyl dyes and phthalocyanine dyes. Typical examples of such dyes are shown hereinafter. These dyes can also be used in such a temporarily short-waved form that the color can be copied at the developing step. As more specific examples, the dyes described in European Patent Publication No. 76,492A can be used.

X is merely a bond, or a connecting group such as an —NR— group (wherein R is a hydrogen atom, an alkyl group or a substituted alkyl group), an —$SO_2$— group, a —CO— group, an alkylene group, a substituted alkylene group, a phenylene group, a substituted phenylene group, a naphthylene group, a substituted naphthylene group, an —O— group, an —SO— group, and a group obtained by combining together two or more of the above groups.

Y is a group which permits the release of Dye in negative or positive relation to a latent image formed imagewise in the light-sensitive silver salt, thereby producing a difference in diffusibility between the Dye released and the compound represented by the formula: Dye-X-Y. These groups are described in the above references, European Pat. Nos. 79,056, 67,455, 76,492 and 66,282. q is an integer of 1 or 2.

An example of Y which is effective for compounds of this type is an N-substituted sulfamoyl group. For example, a group represented by formula (C II) is illustrated for Y.

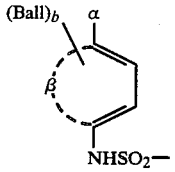

(CII)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like.

$\alpha$ represents a group of —$OG^{11}$ or —$NHG^{12}$ (wherein $G^{11}$ represents hydrogen or a group which forms a hydroxy group upon being hydrolyzed, and $G^{12}$ represents hydrogen, an alkyl group containing 1 to 22 carbon atoms or a hydrolyzable group), Ball represents a ballast group, and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

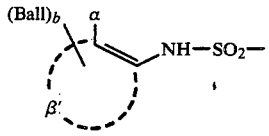

(CIII)

wherein Ball, $\alpha$, and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82, and U.S. Pat. No. 4,053,312.

Further examples of Y suited for this type of compound are those represented by the following formula (CIV):

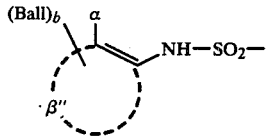

(CIV)

wherein Ball, $\alpha$, and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

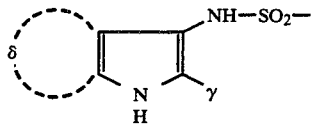

(CV)

wherein $\gamma$ preferably represent hydrogen, a substituted or unsubstituted alkyl, aryl or heterocyclic group, or —CO—$G^{21}$; $G^{21}$ represents —$OG^{22}$, —$SG^{22}$ or

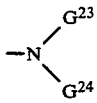

(wherein $G^{22}$ represents hydrogen, an alkyl group, a cycloalkyl group or an aryl group, $G^{23}$ is the same as defined for said $G^{22}$, $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

(CVI)

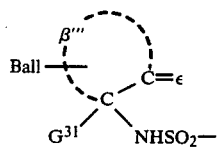

wherein Ball is the same as defined with the formula (CII): $\epsilon$ represents an oxygen atom or $=NG^{32}$ (wherein $G^{32}$ represents hydroxy or an optionally substituted amino group) (examples of $H_2N—G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Ptent Publication Nos. 32129/73, 39165/73, Japanese Patent Application (OPI) No. 64436/74, U.S. Pat. No. 3,443,934, etc.

Still further examples of Y are those represented by the following formula (CVII):

(CVII)

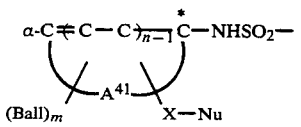

wherein $\alpha$ represents $OR^{41}$ or $NHR^{42}$; $R^{41}$ represents hydrogen or a hydrolyzable component; $R^{42}$ represents hydrogen or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 3 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above-described formula (CII). Specific examples of this type of Y are described in Japanese Patent Application (OPI) No. 20735/82.

As still further type of examples represented by the formula of (CI), there are dye providing non-diffusible substances which release a diffusible dye in the presence of a base as a result of self cyliczation or the like but which, when reacted with an oxidation product of a developing agent, substantially never release the dye.

Examples of Y effective for this type of compound are those which are represented by the formula (CVIII):

(CVIII)

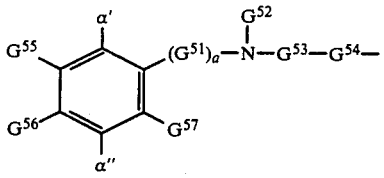

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

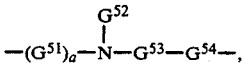

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

(CIX)

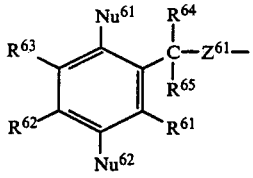

(CX)

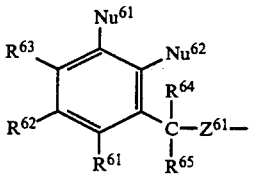

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above-described compounds immobile. Specific examples of this type of Y are described in Japanese Patent Application (OPI) Nos. 69033/78 and 130927/79.

Further examples of Y suited for this type of compound are those which are represented by the formula of (CXI):

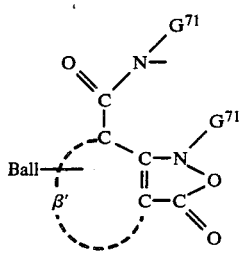

(CXI)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

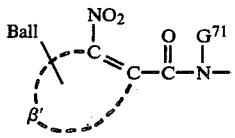

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

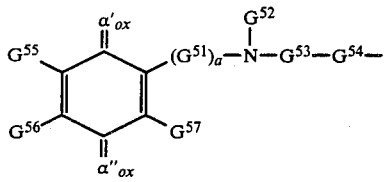

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIVA) and (CXIVB):

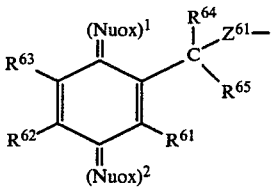

(CXIVA)

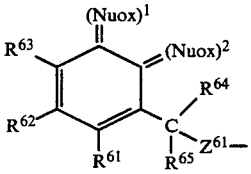

(CXIVB)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIVA) and (CXIVB) describe electron donors to be used in combination.

As still further different type of compound represented by the general formula (CI), there are illustrated LDA compounds (Linked Donor Acceptor Compounds). These compounds are dye providing non-diffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula of (CXV) (specific examples thereof being described in Japanese Patent Application (OPI) No. 60289/83):

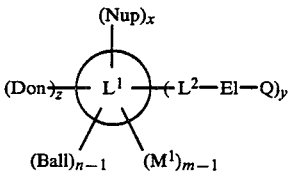

(CXV)

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye providing substance non-diffusible, and is preferably a group containing a $C_{8-32}$ hydrophobic group. Such organic ballast group is bound to the dye providing substance directly or through a linking group (e.g., an imino bond, an ether bond a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of dye image forming substances which can be used in the present invention are described in the patents cited hereinbefore. Since length prevents illustrating all preferred exaamples thereof, only a portion thereof is described hereinafter. Specific examples of the dye providing substances represented by general formula (CI) are set forth below.

(1)

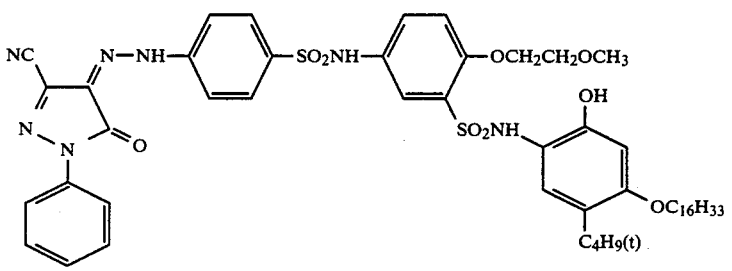

(2)

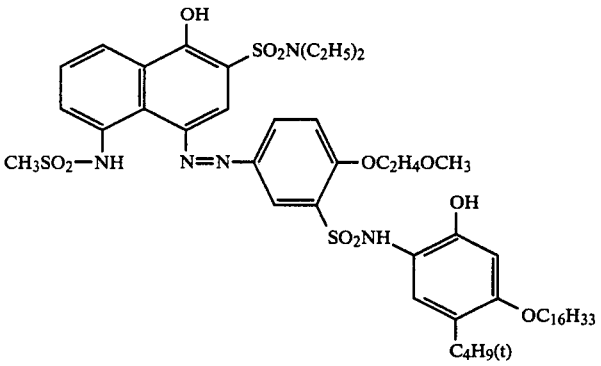

(3)

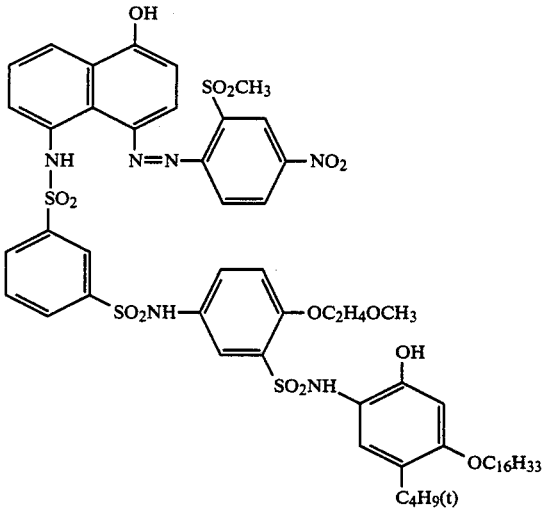

(4)

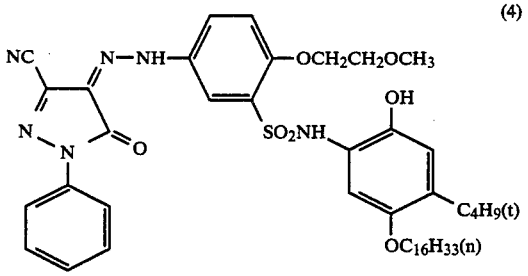

-continued
(5)
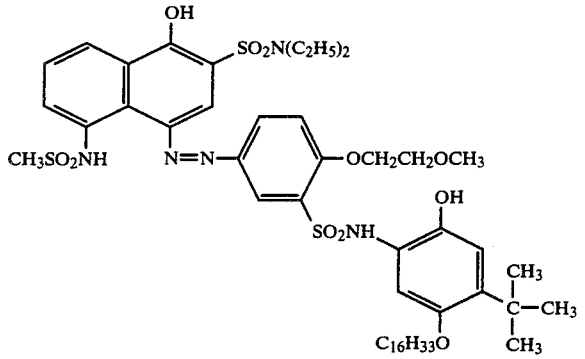
(6)
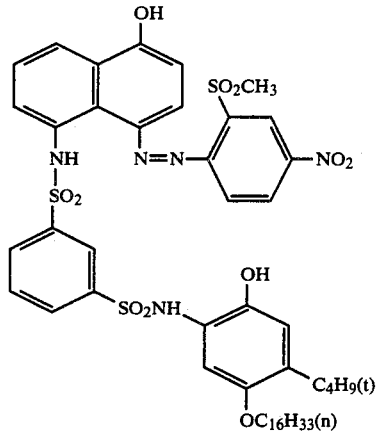
(7)
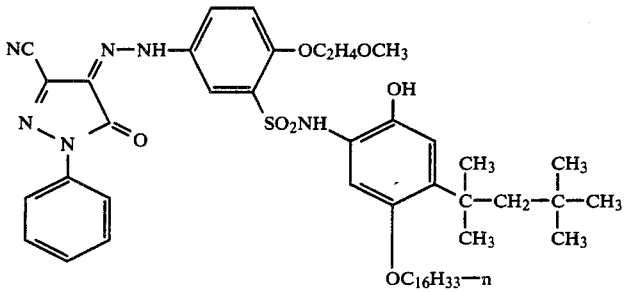
(8)
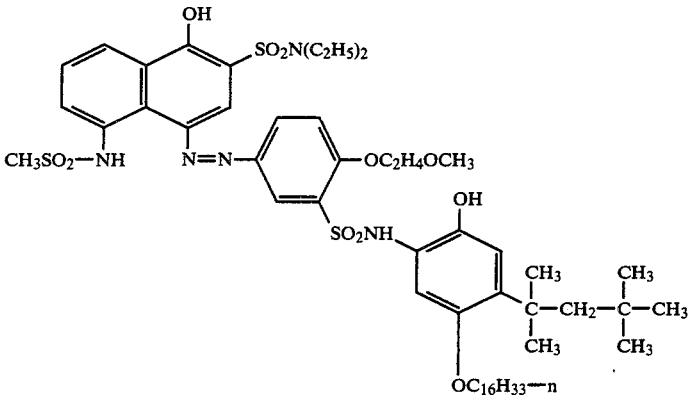
(9)
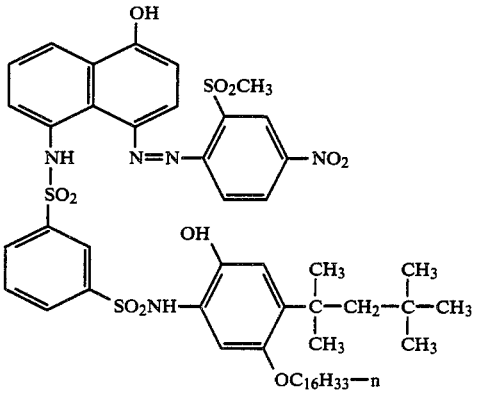
(10)
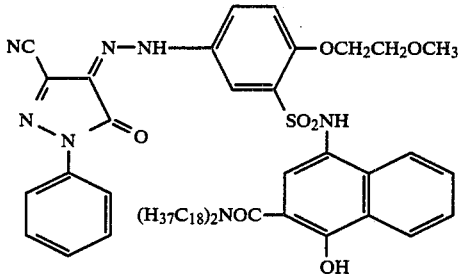

-continued
(11)
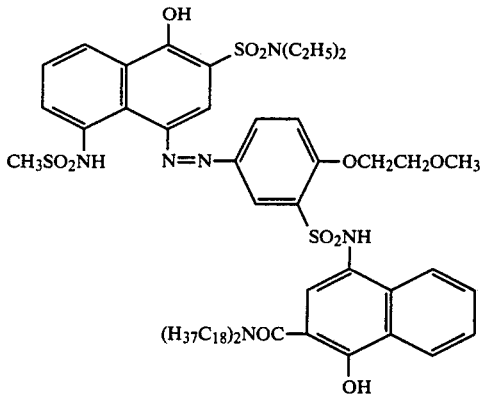
(12)
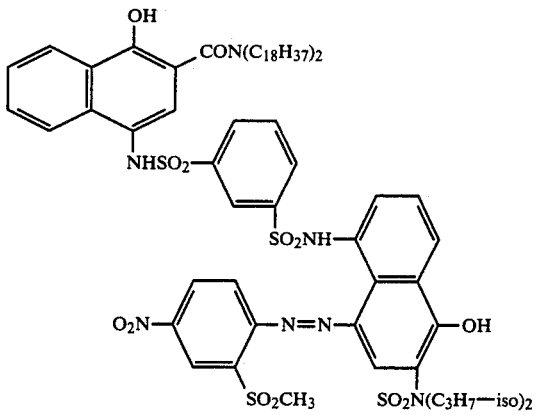
(13)
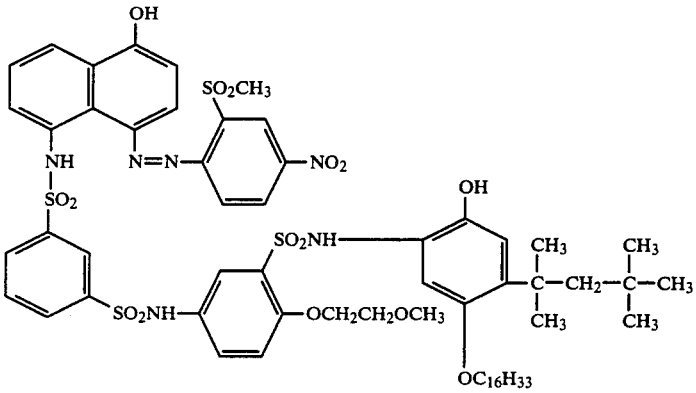
(14)
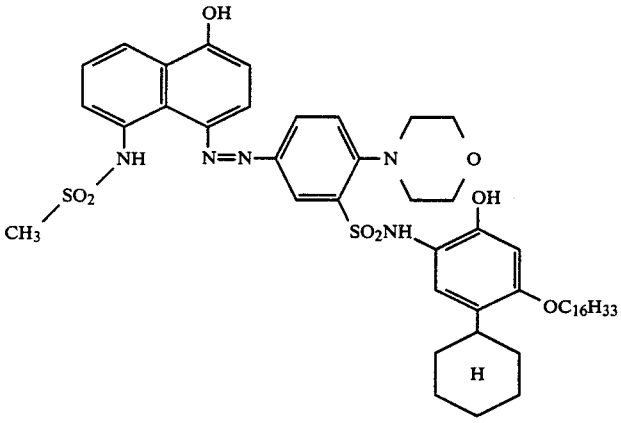
(15)
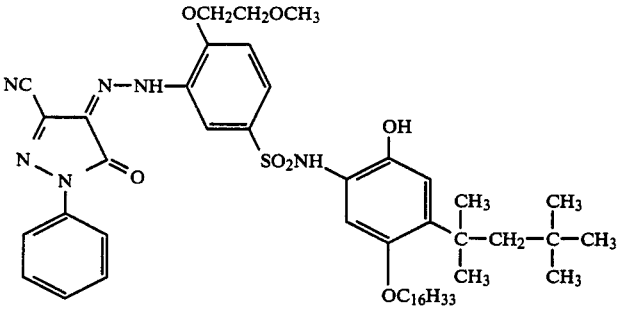
(16)
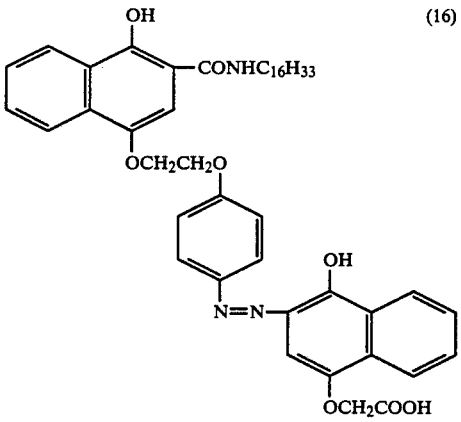

The above described compounds are only given as examples and the present invention should not be construed as being limited thereto.

Most of the dye providing substances described above form an imagewise distributions of a mobile dye corresponding to exposure in light-sensitive materials by heat development. Methods for transfer of such image forming dyes to dye fixing materials (so-called diffusion transfer) to visualize the same are described in the patents cited above.

In the heat-developable light-sensitive material of the present invention, various development stopping agents can be used so that the desired image can be reproducibly obtained in spite of variations in the processing temperature and processing time of the heat development.

The term "development stopping agent" as used herein means a compound which neutralizes or reacts with the base promptly after the proper development, thereby lowering the concentration of the base in the membrane and stopping the development process. Typical examples are acid precursors which release an acid on heating, and compounds which react with the coexisting base on heating, thereby lowering the concentration of the base. The former acid precursors include oximesters described in Japanese Patent Application Nos. 216928/83 (corresponding to U.S. patent application Ser. No. 672,643, filed on Nov. 19, 1984) and 48305/84 (corresponding to U.S. patent application Ser. No. 711,885, filed on Mar. 14, 1984), and compounds releasing an acid by the Rossen rearrangement as described in Japanese Patent Application No. 85834/84 (corresponding to U.S. patent application Ser. No. 727,718, filed on Apr. 26, 1985). The latter compounds reacting with a base on heating include compounds described in Japanese Patent Application No. 85836/84 (corresponding to U.S. patent application Ser. No. 727,978, filed on Apr. 26, 1985).

It is preferred for the development stopping agent to be used in combination with the base precursor because in this case its effect is exhibited efficiently. In this case, the molar ratio of the base precursor to the acid precursor is preferably from 1:20 to 20:1 and more preferably from 1:5 to 5:1.

In the present invention, the dye providing substance can be introduced into light-sensitive materials according to known methods described, for example, in U.S. Pat. No. 2,322,027. In such cases, organic solvents having a high boiling point as described above may be used.

For example, the dye providing substance is dissolved in an organic solvent having a high boiling point such as alkyl phthalate (e.g., dibutyl phthalate, dioctyl phthalate, etc.), a phosphate (diphenyl phosphate, triphenyl phosphate, tricresyl phosphate, dioctylbutyl phosphate, etc.), a citric ester (e.g., tributyl acetylcitrate), a benzoic ester (e.g., octyl benzoate), an alkylamide (e.g., diethyllaurylamide), a fatty acid ester (e.g., dibutoxyethyl succinate, dioctyl azelate, etc.), a trimesic ester (e.g., tributyl trimesate), etc., or an organic solvent having a boiling point of from about 30° C. to about 160° C. such as a lower alkyl acetate (e.g., ethyl acetate, butyl acetate, etc.), ethyl propionate, secbutyl alcohol, methyl isobutyl ketone, β-ethoxyethyl acetate, methyl cellosolve acetate, cyclohexanone or the like, then the resulting solution is dispersed in a hydrophilic colloid. The above described organic solvents having a high boiling point may be used in combination with the organic solvents having a low boiling point.

A method of dispersing the substance using a polymer described in Japanese Patent Publication No. 39853/76 and Japanese Patent Application (OPI) No. 59943/76 may also be employed. In dispersing the dye providing substance in a hydrophilic colloid, various surfactants may be used. As such surfactants, those given to as surfactants in other part of this specification may be used.

In the present invention, the organic solvent having a high boiling point is used in an amount of not more than 10 g, preferably not more than 5 g, per g of the dye providing substance used.

In the present invention, if desired, a reducing agent may be used.

Examples of reducing agents to be used in the present invention include the following: hydroquinone compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecylamino)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.), etc.

More preferable examples of the reducing agents are 3-pyrazolidone compounds (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, etc.).

Combinations of various developing agents as described in U.S. Pat. No. 3,039,869 may be used as well.

In the present invention, the reducing agent is generally added in an amount of from 0.01 to 20 mols, and particularly preferably from 0.1 to 10 mols, per mol of silver.

In the present invention, it is particularly preferred to use various bases or base precursors as dye releasing assistants.

The bases or precursors thereof can be used in a light-sensitive material and/or a dye fixing material. In the case of incorporating them in a light-sensitive material, it is particularly advantageous to use base precursors, and to add them to the layer containing the acid precursors or a layer adjacent to the layer containing the acid precursors. The term "base precursor" used herein means a substance which releases a base component by heating to a temperature of development, where the base component released may by any inorganic base or organic base.

As examples of preferred bases, there are, as inorganic bases, hydroxides, secondary or tertiary phosphates, borates, carbonates, quinolinates and metaborates of alkali metals or alkaline earth metals; ammonium hydroxide; quaternary alkylammonium hydroxide; and other metal hydroxides; etc., and, as organic bases, aliphatic amines, aromatic amines, heterocyclic amines, amidines, cyclic amidines, guanidines, cyclic guanidines, etc. In the present invention, compounds having a pKa value of 8 or more are particularly useful.

As the base precursors, substances which undergo reaction by heating to release a base, such as salts of an organic acid which is decarboxylated by heating to undergo decomposition and yield a base, or compounds which are decomposed by Lossen rearrangement or Beckmann rearrangement to release an amine, are used.

As preferred base precursors, there are precursors of the above described organic bases. For example, there are salts of thermally decomposable organic acids such as trichloroacetic acid, propiolic acid, cyanoacetic acid, sulfonylacetic acid, acetoacetic acid, etc., and salts of 2-carboxycarboxamide as described in U.S. Pat. No. 4,088,496, etc.

Specific examples of preferred bases are set forth below, but the present invention should not be construed as being limited to these compounds.

Lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (Me represents $CH_3$ hereinafter), $Me_2NH$, $EtNH_2$ (Et represents $C_2H_5$ hereinafter), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

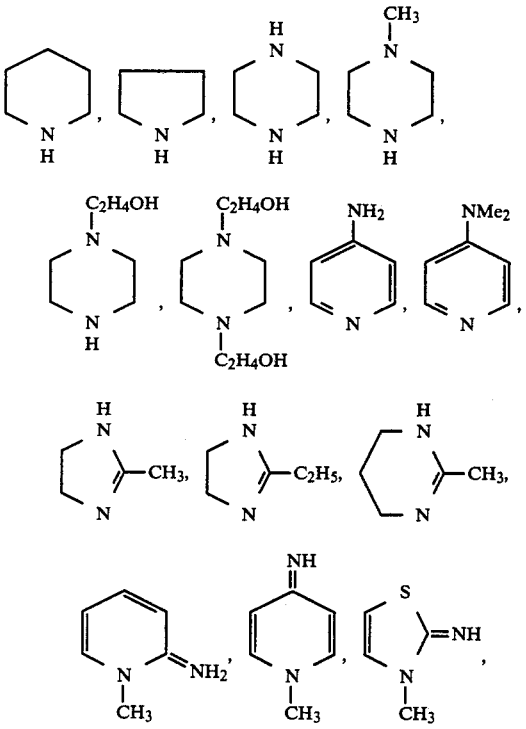

-continued

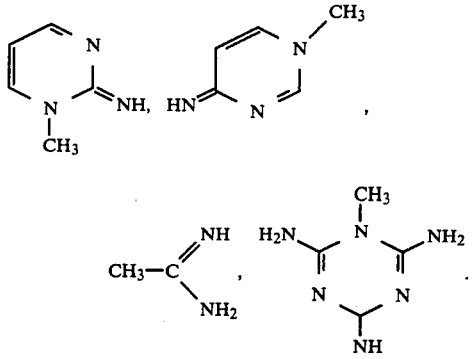

Specific examples of preferred base precursors are set forth below, but the present invention should not be construed as being limited thereto.

As trichloroacetic acid derivatives, there are guanidine trichloroacetic acid, piperidine trichloroacetic acid, morphiline trichloroacetic acid, p-toluidine trichloroacetic acid, 2-picoline trichloroacetic acid, etc. These compounds are believed to release a base by decarboxylation of the acid moiety.

In addition, base precursors as described in British Pat. No. 998,945, U.S. Pat. No. 3,220,846, Japanese Patent Application (OPI) No. 22625/75, etc., can be used.

As substances besides trichloroacetic acids, there are 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application (OPI) No. 180537/84, etc. Salts using alkali metal or an alkaline earth metal as a base component other than organic bases are also effective.

As other precursors, hydroxamic carbamates as described in Japanese Patent Application (OPI) No. 168440/84 utilizing Lossen rearrangement and aldoxime carbamates as described in Japanese Patent Application (OPI) No. 157637/84 which form a nitrile, etc., are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the total weight of the dried coating layers on the support in the light-sensitive material, and, preferably a range of from 0.01% by weight to 40% by weight.

The above-described bases or base precursors can be used not only for the acceleration of dye release but also for other purposes such as the control of a pH value.

In order to adequately stop the development, the photographic material of the present invention preferably contains a compound capable of releasing an acid during heating (i.e., acid precursor), such as oxime esters as described in Japanese Patent Application No. 216928/83 (corresponding to U.S. patent application Ser. No. 672,643, filed on Nov. 19, 1984), or phenyl benzoate derivatives or alkyl benzoate derivatives.

Examples of the light-sensitive silver halide include silver chloride, silver chlorobromide, silver chloroiodide, silver bromide, silver iodobromide, silver chloroiodobromide, silver iodide, etc.

These silver halides may be obtained as follows. With silver bromide, for example, a silver nitrate solution is added to a potassium bromide solution to form silver bromide grains, followed by adding thereto potassium iodide.

As the silver halide, two or more silver halides different from each other in size and/or halide composition may be used in combination.

Silver halide grains to be used in the present invention preferably have an average grain size (diameter) of 0.001 μm to 10 μm, more preferably 0.001 μm to 5 μm.

The silver halide to be used in the present invention may be used as such, or may be chemically sensitized by using chemical sensitizers such as compounds of sulfur, selenium or tellurium, compounds of gold, platinum, palladium, rhodium or iridium, reducing agents such as tin halide, or a combination thereof. Detailed descriptions thereon are given in T. H. James, *The Theory of the Photographic Process,* 4th Ed., Chap. 5, pp. 149 to 169.

A suitable coating amount of the light-sensitive silver halide in the present invention is from 1 mg to 10 g/m$^2$ calculated as an amount of silver.

The silver halide used in the present invention can be spectrally sensitized with methine dyes or other dyes. Suitable dyes which can be employed include cyanine dyes, merocyanine dyes, complex cyanine dyes, complex herocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,735,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

In the present invention, organic silver salt may be used.

Organic silver salt oxidizing agents are compounds capable of forming a silver image as a function of reaction with the above described dye providing substance or a reducing agent which is, if necessary, allowed to copresent with the dye providing substance, when heated to 80° C. or above, preferably 100° C. or above, in the presence of light-sensitive silver halide.

Examples of such organic silver salt oxidizing agents are described in Japanese Patent Application (OPI) No. 58543/83, and include, for example, those described below.

Firstly, silver salts of organic compounds having a carboxy group can be used. Typical examples thereof include silver salts of aliphatic and aromatic carboxylic acids.

Other examples include silver salts of compounds having a mercapto group or a thione group and the derivatives thereof.

In addition, there are silver salts of compounds containing an imino group, such as silver salts of benzotriazole and derivatives thereof described in Japanese Patent Publication Nos. 30270/69 and 18416/70, silver salts of benzotriazole, silver salts of alkyl-substituted benzotriazoles (e.g., silver salt of methylbenzotriazole, etc.), silver salts of halogen-substituted benzotriazoles (e.g., silver salt of 5-chlorobenzotriazole), silver salts of carboimidobenzotriazoles (e.g., silver salt of butylcarboimidobenzotriazole), silver salts of 1,2,4-triazole and 1-H-tetrazole described in U.S. Pat. No. 4,220,709, silver salt of carbazole, silver salt of saccharin, silver salt of imidazole or imidazole derivative, etc.

Silver salts described in *Research Disclosure,* Vol. 170 (RD-17029) and organometallic salts such as copper stearate are also usable in the present invention as the organometallic salt oxidizing agents.

Processes for preparing these silver halides and organic silver salts and methods for mixing them are described in *Research Disclosure,* Vol. 170, June 1978 (RD-17029), Japanese Patent Application (OPI) Nos. 32928/75, 42529/76, 13224/74 and 17216/75, and U.S. Pat. No. 3,700,458.

A suitable coating amount of the light-sensitive silver halide and the organic silver salt is from 50 mg to 10 g/m$^2$ calculated as an amount of silver.

The above described light-sensitive silver halide and organic silver salt oxidizing agent are prepared in the following binder, and the dye providing substance is dispersed in the following binder.

Binders to be used in the present invention may be used alone or in combination. Hydrophilic binders may be used. Typical examples of the hydrophilic binder are transparent or semitransparent hydrophilic binders and include natural substances such as proteins (e.g., gelatin, gelatin derivatives and cellulose derivatives) and polysaccharides (e.g., starch, gum arabic, etc.) and synthetic polymer substances such as water-soluble polyvinyl compounds (e.g., polyvinylpyrrolidone, acrylamide polymer, etc.). Other synthetic polymer substances include dispersed vinyl compounds in a latex form, which serve to increase dimensional stability of the photographic materials.

In the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The light-sensitive material (photosensitive material) of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat-developable photosensitive material used, processing conditions, desired images and various other factors, generally ranges from about 0.001 to 0.1 mol per mol of silver in the photosensitive material.

The above described various ingredients to constitute a heat-developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat-developable photosensitive material can be reduced. Therefore, such distribution of additives is of advantage to some cases.

The heat-developable photosensitive materials of the present invention are effective in forming both negative or positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

Supports to be used in the light-sensitive material of the present invention must withstand the processing temperatures used. As general supports, an acetylcellulose film, a cellulose ester film, a polyvinyl acetal film, a polystyrene film, a polycarbonate film, a polyethylene terephthalate film, and related films or resin materials are used as well as glass, paper, metal and analogs thereof. Paper supports laminated with a polymer such as polyethylene may also be used. Polyesters described in U.S. Pat. Nos. 3,634,039 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as metahanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer; the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079 and Japanese Patent Application No. 28928/83 (corresponding to U.S. patent application Ser. No. 582,655, filed on Feb. 23, 1984) and U.S. Pat. No. 4,503,137. Methods for the exposure and so on cited in the described patents can be employed in the present invention also.

The present invention is now illustrated in greater detail by reference to the following examples which, however, are not to be construed as limiting the present invention in any way.

| | | |
|---|---|---|
| (a) | Silver iodobromide emulsion | 10 g |
| (b) | Dispersion of the couplers in gelatin | 3.5 g |
| (c) | 10% Methanol solution of P-1 (polymeric base precursor of the present invention) | 6.0 g |
| (d) | 10% Aqueous solution of gelatin | 5 g |
| (e) | Solution of 0.2 g of 2,6-dichloro-p-aminophenol in 17 ml of water | |

Preparation of Light-Sensitive Material B

Light-Sensitive Material B was prepared in the same manner as in the preparation of the Light-Sensitive Material A except that 6.0 g of the 10% methanol solution of P-1 (polymeric base precursor) (c) above was replaced by 2.4 g of a 5% aqueous solution of guanidinetrichloroacetic acid.

Light-Sensitive Materials A and B were exposed imagewise for 5 seconds at 2,000 lux by the use of a tungsten lamp either just after the preparation or after being stored for 2 days at a temperature of 60° C. On uniformly heating the exposed materials for 30 seconds on a heat block maintained at 150° C., a negative cyan image was formed. The density of the image was measured by a Macbeth transmittant densitometer (TD-504), and the results are shown in Table 1.

TABLE 1

| Light-Sensitive Material | Base Precursor | Just after Preparation | | After Storage at 60° C. for 2 Days | | Remarks |
|---|---|---|---|---|---|---|
| | | Maximum Density | Minimum Density | Maximum Density | Minimum Density | |
| A | P-1 | 1.74 | 0.28 | 1.80 | 0.29 | Present Invention |
| B | Guanidinetrichloro-acetic Acid | 1.80 | 0.25 | 1.81 | 1.02 | Comparative Example |

EXAMPLE 1

Preparation of Silver Iodobromide Emulsion

A mixture of 40 g of gelatin and 26 g of potassium bromide (KBr) was dissolved in 3,000 ml of water, and the resulting solution was stirred while maintaining at 50° C. A solution of 34 g of silver nitrate dissolved in 200 ml of water was added to the above solution over 10 minutes. Then, a solution of 3.3 g of potassium iodide (KI) dissolved in 100 ml of water was added to the solution over 2 minutes.

The silver iodobromide emulsion thus prepared was adjusted in pH, precipitated, and freed of excess salts.

The emulsion was adjusted to pH 6.0 to obtain 400 g of the desired silver iodobromide emulsion.

Preparation of Dispersion of Coupler in Gelatin

A mixture of 5 g of 2-dodecylcarbamoyl-1-naphthol, 0.5 g of sodium 2-ethylhexyl sulfosuccinate, and 2.5 g of tricresyl phosphate (TCP) was dissolved in 30 ml of ethyl acetate. The resulting solution was mixed with 100 g of a 10% gelatin solution and dispersed therein by agitating at 10,00 rpm for 10 minutes by the use of a homogenizer.

Preparation of Light-Sensitive Material A

A composition as shown below was coated on a polyethylene terephthalate film support in a wet thickness of 60 μm and then dried to prepare the desired light-sensitive material (Light-Sensitive Material A).

It can be seen from Table 1 that Light-Sensitive Material B using guanidinetrichloroacetic acid described in U.S. Pat. No. 3,220,846 can produce an image of high density just after preparation but after being stored for a certain period can produce only an image increased in fog; that is, Light-Sensitive Material B is poor in storage stability.

On the other hand, Light-Sensitive Material A using the polymeric base precursor (P-1) of the present invention can produce an image of high density and decreased fog both just after preparation and after storage for a certain period; that is, Light-Sensitive Material A is satisfactory in both the developing activity and storage stability.

EXAMPLE 2

Preparation of Silver Iodobromide Emulsion

The same silver iodobromide emulsion as used in Example 1 was used.

Preparation of Dispersion of Dye Providing Substance

A mixture of 5 g of a dye providing substance having the following formula:

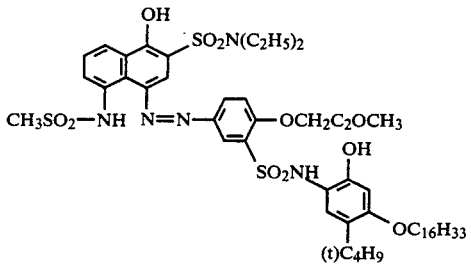

0.5 g of sodium 2-ethylhexyl sulfosuccinate as a surface active agent, and 5 g of tricresyl phosphate (TCP) was dissolved in 30 ml of ethyl acetate by heating at about 60° C. The resulting solution and 100 g of a 10% solution of gelatin were mixed and dispersed therein by agitating for 10 minutes at 10,000 rpm by the use of a homogenizer.

Preparation of Light-Sensitive Material C

| | | |
|---|---|---|
| (a) | Light-sensitive silver iodobromide emulsion (same as used in Example 1) | 25 g |
| (b) | Dispersion of the dye providing substance | 33 g |
| (c) | 5% Aqueous solution of the compound having the following formula: | 10 ml |
| | 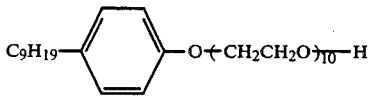 | |
| (d) | 10% Aqueous solution of the compound having the following formula: $H_2NSO_2N(CH_3)_2$ | 4 ml |
| (e) | 20% Methanol solution of the polymeric base precursor (P-1) of the present invention | 20 ml |

The above ingredients (a) to (e) were mixed and dissolved by heating, coated on a polyethylene terephthalate film support in a wet thickness of 30 μm, and then dried to produce the desired light-sensitive material (Light-Sensitive Material C).

Preparation of Light-Sensitive Materials D, E, F, G, H and I

Light-Sensitive Materials D, E, F, G, H and I were produced in the same manner as in the preparation of Light-Sensitive Material C except that the polymeric base precursor (P-1) as (e) was replaced by each base precursor shown in Table 2.

TABLE 2

| Light-Sensitive Material | Base Precursor | Amount | Remarks |
|---|---|---|---|
| C | P-1 | 20 ml as a 20% methanol solution | Present Invention |
| D | P-3 | 20 ml as a 20% MEK solution | Present Invention |
| E | P-4 | 25 ml as a 20% MEK solution | Present Invention |
| F | P-5 | 25 ml as a 20% methanol solution | Present Invention |
| G | P-8 | 25 ml as a 20% MEK solution | Present Invention |
| H | P-10 | 20 ml as a 20% MEK solution | Present Invention |
| I | Guanidine-trichloro-acetic acid | 20 ml as a 5% aqueous solution | Comparative Example |

Preparation of Image Receiving Material with Image Receiving Layer

A methyl acrylate/N,N,N-trimethyl-N-vinylbenzylammonium chloride (1:1) copolymer (10 g) was dissolved in 200 ml of water and then uniformly mixed with 100 g of 10% lime-treated gelatin. The mixture thus formed was uniformly coated in a wet thickness of 90 μm on a paper support laminated with polyethylene in which titanium dioxide had been dispersed. The material thus produced was then dried and used as an image receiving material.

Light-Sensitive Materials C to I were exposed imagewise for 10 seconds at 2,000 lux using a tungsten lamp either just after preparation or after being stored for 2 days at 60° C. Each light-sensitive material was uniformly heated for 30 seconds on a heat block maintained at 150° C.

The light-sensitive material thus heated was superimposed on the image receiving material soaked in water, in such a manner that the coatings on the materials came into contact with each other, and then heated for 6 seconds on a heat block maintained at 80° C. Upon separation of the light-sensitive material from the image receiving material, a negative magenta dye image was formed on the image receiving material. The density of the negative image was measured with a Macbeth reflective densitometer (RD-519), and the results are shown in Table 3.

TABLE 3

| Light-Sensitive Material | Base Precursor | Just after Preparation | | After Storage at 60° C. for 2 Days | | Remarks |
|---|---|---|---|---|---|---|
| | | Maximum Density | Minimum Density | Maximum Density | Minimum Density | |
| C | P-1 | 1.69 | 0.24 | 1.70 | 0.26 | Present Invention |
| D | P-3 | 1.81 | 0.25 | 1.81 | 0.25 | Present Invention |
| E | P-4 | 1.67 | 0.19 | 1.68 | 0.20 | Present Invention |
| F | P-5 | 1.73 | 0.21 | 1.75 | 0.19 | Present Invention |
| G | P-8 | 1.73 | 0.23 | 1.72 | 0.23 | Present Invention |
| H | P-10 | 1.83 | 0.21 | 1.81 | 0.25 | Present Invention |
| I | Guanidinetrichloro-acetic Acid | 1.87 | 0.21 | 1.81 | 1.33 | Comparative Example |

It can be seen from Table 3 that Light-Sensitive Material I using guanidinetrichloroacetic acid can produce an image of high density just after preparation but after storage for a certain period of time can produce only an image of increased fog; that is, Light-Sensitive Material I is poor in storage stability.

On the other hand, Light-Sensitive Materials C through H using the polymeric base precursors P-1, P-3, P-4, P-5, P-8 and P-10 of the present invention can produce an image of high density and decreased fog both just after preparation and after storage for a certain period of time; that is, they are satisfactory in both the developing activity and storage stability.

EXAMPLE 3

Preparation of Silver Benzotriazole Emulsion Containing Light-Sensitive Silver Bromide A mixture of 6.5 g of benzotriazole and 10 g of gelatin was dissolved in 1,000 ml of water, and the resulting solution was stirred while maintaining at 50° C. Then, a solution of 8.5 g of silver nitrate in 100 ml of water was added to the solution over 2 minutes. In addition, a solution of 1.2 g of potassium bromide in 50 ml of water was added over 2 minutes. The emulsion thus prepared was precipitated by adjusting its pH and freed of excess salts. The emulsion was then adjusted to pH 6.0. The yield was 200 g.

Preparation of Dispersion of Dye Providing Substance in Gelatin

A mixture of 10 g of a dye providing substance having the following formula:

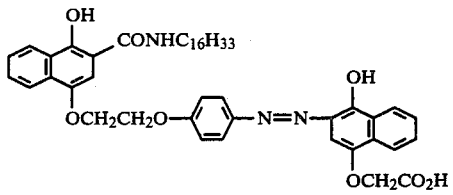

0.5 g of sodium 2-ethylhexyl sulfosuccinate as a surface active agent, and 4 g of tricresyl phosphate (TCP) was dissolved in 20 ml of cyclohexanone by heating to about 60° C. to prepare a uniform solution. This solution was mixed with 100 g of a 10% solution of lime-treated gelatin and dispersed therein by agitating for 10 minutes at 10,000 rpm by the use of a homogenizer.

Preparation of Light-Sensitive Material J

| | | |
|---|---|---|
| (a) | Silver benzotriazole emulsion containing light-sensitive silver bromide | 10 g |
| (b) | Dispersion of the dye providing substance | 3.5 g |
| (c) | 10% Methanol solution of the polymeric base precursor (P-1) of the present invention | 5.0 g |
| (d) | 10% Aqueous solution of gelatin | 5 g |
| (e) | Solution of 200 ml of 2,6-dichloro-4-aminophenol dissolved in 2 ml of methanol | |

The above ingredients (a) to (e) were mixed and dissolved by heating, coated on a 180 μm thick polyethylene terephthalate film support in a wet thickness of 30 μm, and then dried to produce the desired light-sensitive material (Light-Sensitive Material J).

Preparation of Light-Sensitive Material K

Light-Sensitive Material K was produced in the same manner as in the production of Light-Sensitive Material J except that 5.0 g of the polymeric base precursor (P-1) (10% methanol solution) as (c) was replaced by 3.0 g of guanidinetrichloroacetic acid (5% aqueous solution).

Light-Sensitive Materials J and K were exposed imagewise for 10 seconds at 2,000 lux by the use of a tungsten lamp either just after preparation or after storage for 2 days at 60° C. The light-sensitive material thus exposed were uniformly heated for 30 seconds on a heat block maintained at 150° C.

Each light-sensitive material was processed in the same manner as in Example 2, using the same image receiving material as in Example 2, whereupon a negative magenta color image was formed on the image receiving material. The density of the negative image was measured with a Macbeth reflective densitometer (RD-519). The results are shown in Table 4.

TABLE 4

| Light-Sensitive Material | Base Precursor | Just after Preparation | | After Storage at 60° C. for 2 Days | | Remarks |
|---|---|---|---|---|---|---|
| | | Maximum Density | Minimum Density | Maximum Density | Minimum Density | |
| J | P-1 | 1.72 | 0.29 | 1.73 | 0.30 | Present Invention |
| K | Guanidinetrichloroacetic Acid | 1.73 | 0.22 | 1.77 | 1.21 | Comparative Example |

It can be seen from Table 4 that Light-Sensitive Material K using guanidinetrichloroacetic acid can produce an image of high densith just after preparation but after storage for a certain period of time can produce only an image increased in fog; that is, Light-Sensitive Material K is poor in storage stability.

On the other hand, Light-Sensitive Material J using the polymeric base precursor (P-1) of the present invention can produce an image of high density and decreased fog both just after preparation and after storage for a certain period of time; that is, Light-Sensitive Material J is satisfactory in both the developing activity and storage stability.

EXAMPLE 4

Preparation of Dispersion of Dye Providing Substance in Gelatin

A mixture of 5 g of a reducible dye releasing agent having the following formula:

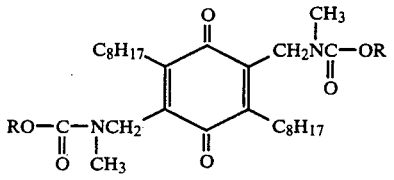

wherein R is:

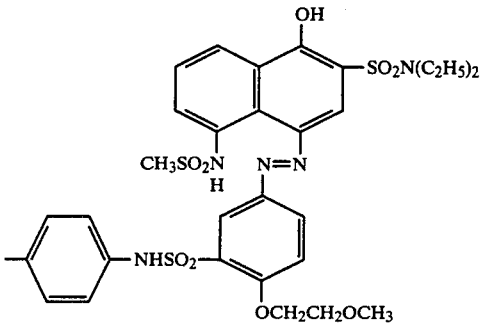

4 g of an electron donating substance having the following formula:

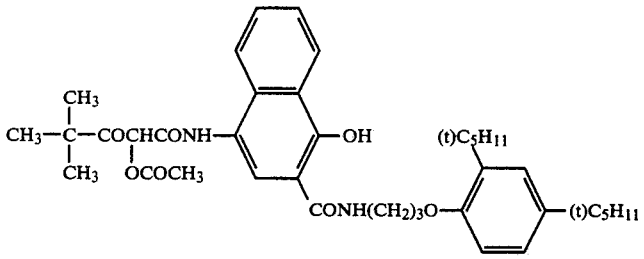

0.5 g of sodium 2-ethylhexyl sulfosuccinate, and 10 g of tricresyl phosphate (TCP) was dissolved in 20 ml of cyclohexanone by heating to about 60° C. The solution thus prepared was mixed with 100 g of a 10% solution of gelatin and dispersed therein by agitating for 10 minutes at 10,000 rpm by the use of a homogenizer.

Preparation of Light-Sensitive Material L

| | | | |
|---|---|---|---|
| (a) | Silver benzotriazole emulsion containing light-sensitive silver bromide (same as used in Example 3) | 10 | g |
| (b) | Dispersion of the dye providing substance | 3.5 | g |
| (c) | 10% Methanol solution of the polymeric base precursor (P-1) of the present invention | 5.0 | g |
| (d) | 5% Aqueous solution of a compound having the following formula: | 1.5 | ml |

-continued

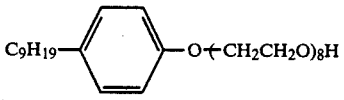

The above ingredients (a) to (d) were mixed and dissolved by heating, coated on a polyethylene terephthalate film in a wet thickness of 30 μm, and then dried to produce the desired light-sensitive material (Light-Sensitive Lateral L).

Preparation of Light-Sensitive Material M

Light-Sensitive Material M was produced in the same manner as in the preparation of Light-Sensitive Material L except that 5.0 g of the 10% methanol solution of the polymeric base precursor (P-1) of the present invention as (c) was replaced by 3.0 g of a 5% aqueous solution of guanidinetrichloroacetic acid.

Light-Sensitive Materials L and M were exposed imagewise for 10 seconds at 2,000 lux by the use of a tungsten lamp either just after preparation or after storage at 60° C. for 2 days. They were then uniformly heated for 30 seconds on a heat block maintained at 150° C.

Each light-sensitive material was processed in the same manner as in Example 2, using the same image receiving material as used in Example 2, whereupon a positive magenta image was formed on the image receiving material. The density of the positive image was measured by the use of a Macbeth reflective densitometer (RD-519), and the results are shown in Table 5.

TABLE 5

| Light-Sensitive Material | Base Precursor | Just after Preparation | | After Storage at 60° C. for 2 Days | | Remarks |
|---|---|---|---|---|---|---|
| | | Maximum Density | Minimum Density | Maximum Density | Minimum Density | |
| L | P-1 | 1.64 | 0.36 | 1.66 | 0.37 | Present Invention |
| M | Guanidinetrichloroacetic Acid | 1.70 | 0.28 | 1.71 | 1.35 | Comparative Example |

It can be seen from Table 5 that Light-Sensitive Material M using guanidinetrichloroacetic acid can produce an image of high density just after preparation thereof but after storage for a certain period of time can produce only an image seriously increased in fog; that is, Light-Sensitive Material M is poor in storage stability.

On the other hand, the light-sensitive material using the polymeric base precursor (P-1) of the present invention can produce an image of high density and decreased fog both just after preparation and after storage for a certain period of time; that is, Light-Sensitive Material L is satisfactory in both developing activity and storage stability.

As can be seen from Examples 1 to 4, in various types of heat-developable light-sensitive materials, the polymeric base precursors of the present invention can increase their developing activity and storage stability more than conventional base precursors.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material which contains a polymer having a functional group releasing a basic component upon thermal decomposition in the side chain thereof, wherein said polymer is a compound having a repeating unit represented by the following general formula (I):

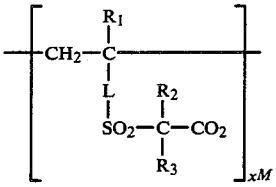

(I)

wherein $R_1$, $R_2$ and $R_3$ are each a univalent group, L is a divalent connecting group having from 1 to 20 carbon atoms, M is a cation and x is a number equivalent with the valence of M.

2. A heat-developable light-sensitive material as claimed in claim 1, wherein said polymer is a salt of polymer carboxylic acids causing decarboxylation at 80° to 250° C.

3. A heat-developable light-sensitive material as claimed in claim 2, wherein said polymer is a salt of polymer carboxylic acids causing decarboxylation at 100° to 200° C.

4. A heat-developable light-sensitive material as claimed in claim 1, which additionally contains light-sensitive silver halide and a dye providing substance represented by the formula (CI):

$$(\text{Dye}—X)_q—Y \qquad \text{(CI)}$$

wherein Dye represents a dye which becomes mobile when released from the molecule; X is a bond or a connecting group selected from the group consisting of —NR— (wherein R is a hydrogen atom, an alkyl group, or a substituted alkyl group), —$SO_2$—, —CO—, an alkylene group, a substituted alkylene group, a phenylene group, a substituted phenylene group, a naphthylene group, a substituted naphthylene group, —O—, —SO—, and a group obtained by combining together two or more of the above groups; Y is a group which permits the release of Dye in negative or positive relation to a latent image formed imagewise in a light-sensitive silver salt; and q represents an integer of 1 or 2.

5. A heat-developable light-sensitive material as claimed in claim 1, wherein $R_1$, $R_2$ and $R_3$ are each one univalent group selected from the group consisting of a hydrogen atom, a lower alkyl group having from 1 to 6 carbon atoms, a carboxyl group, a cyano group, a nitro group, an alkoxycarbonyl group, an aryl group and an aralkyl group.

6. A heat-developable light-sensitive material as claimed in claim 1, wherein L is a divalent connecting group having from 1 to 20 carbon atoms selected from the group consisting of an alkylene group, a phenylene group, an arylenealkylene group, —$CO_2$—, —$CO_2$—$R_5$— (wherein $R_5$ is a divalent group), —CONH—$R_5$— (wherein $R_5$ is a divalent group), and $$—CO—\overset{\overset{R_1}{|}}{N}—R_5—$$

(wherein $R_1$ is as defined in claim 1 and $R_5$ is a divalent group).

7. A heat-developable light-sensitive material as claimed in claim 1, wherein M is one member selected from the group consisting of an alkali metal ion, an alkaline earth metal ion, a quaternary ammonium ion and a protonated base.

8. A heat-developable light-sensitive material as claimed in claim 1, wherein said polymer additionally has repeating units for the purpose of controlling solubility and/or a glass transition point.

9. A heat-developable light-sensitive material as claimed in claim 8, wherein said additional repeating unit is a monomer unit resulting from copolymerization of a vinyl monomer capable of controlling solubility and/or a glass transition point.

10. A heat-developable light-sensitive material as claimed in claim 1, wherein said polymer additionally has repeating units derived from a vinyl monomer containing two or more copolymerizable unsaturated bonds in the molecule, said vinyl monomer being capable of transforming said polymer into a cross-linked latex.

11. A heat-developable light-sensitive material as claimed in claim 1, wherein said repeating unit represented by the general formula (I) is from 10 to 100 mol% of said polymer.

12. A heat-developable light-sensitive material as claimed in claim 1, wherein the molecular weight of the polymer is at least 10,000.

13. A heat-developable light-sensitive material as claimed in claim 1, wherein the polymer is used in solution form and has a molecular weight of less than 1,000,000.

14. A heat-developable light-sensitive material as claimed in claim 10, wherein the molecular weight of the polymer is great enough that the polymer is used in the form of a dispersion.

15. A heat-developable light-sensitive material as claimed in claim 1, wherein the weight of the polymer (calculated as the weight of base precursor unit) per coating film is approximately 50 wt% or less.

16. A heat-developable light-sensitive material as claimed in claim 15, wherein the amount of polymer per coating film is approximately 0.01 to 40 wt%.

* * * * *